US005749531A

United States Patent [19]

Shelton et al.

[11] Patent Number: 5,749,531

[45] Date of Patent: May 12, 1998

[54] YARN CREELS

[75] Inventors: William Ewart Alan Shelton; Mark Alan Shelton, both of Croft, England

[73] Assignee: Alan Shelton Limited, England

[21] Appl. No.: 495,438

[22] PCT Filed: Jan. 5, 1994

[86] PCT No.: PCT/GB94/00017

§ 371 Date: Sep. 26, 1995

§ 102(e) Date: Sep. 26, 1995

[87] PCT Pub. No.: WO94/16130

PCT Pub. Date: Jul. 21, 1994

[30] Foreign Application Priority Data

| | | | |
|---|---|---|---|
| Jan. 6, 1993 | [GB] | United Kingdom | 9300184 |
| Feb. 19, 1993 | [GB] | United Kingdom | 9303407 |
| Aug. 3, 1993 | [GB] | United Kingdom | 9316040 |

[51] Int. Cl.[6] ..... B65H 49/02; A47L 15/00; A47L 5/14; D01H 11/00

[52] U.S. Cl. ..... 242/131.1; 15/301; 15/346; 57/304

[58] Field of Search ..... 242/131, 131.1; 57/304; 15/301, 346

[56] References Cited

U.S. PATENT DOCUMENTS

| | | | |
|---|---|---|---|
| 1,982,997 | 12/1934 | Linder | 57/304 X |
| 2,120,888 | 6/1938 | Eaddy | 242/131.1 |
| 3,459,010 | 8/1969 | Ferri | 15/301 X |
| 4,333,201 | 6/1982 | Rohner | 15/346 X |
| 4,784,349 | 11/1988 | Renwick et al. | 242/131 |
| 4,903,367 | 2/1990 | Brunner | 242/131.1 X |

FOREIGN PATENT DOCUMENTS

| | | | |
|---|---|---|---|
| 0 335 230 | 10/1989 | European Pat. Off. | 242/131 |
| 0335230 | 10/1989 | European Pat. Off. . | |
| 0509483 | 10/1992 | European Pat. Off. . | |
| 3629559 | 3/1988 | Germany . | |
| 4030940 | 4/1992 | Germany . | |
| 9204737 | 5/1992 | Germany . | |
| 552018 | 11/1956 | Italy | 57/304 |
| 383233 | 12/1964 | Switzerland | 57/304 |

*Primary Examiner*—Michael Mansen

*Attorney, Agent, or Firm*—Young & Basile, P.C.

[57] ABSTRACT

A yarn creel 20 includes vertical ducts 27 having openings 28 therein through which air is directed towards the upper surfaces of yarn cones 22 mounted on pins 21. Yarn drawn off from the cones 22 exits the creel 20 via tubes 23 whose entrance ends 24 are contained within a further duct 25, the duct 25 having slots 26 through which air is drawn from the interior of the creel 20. A fan 30 circulates this air so that it is re-emitted from the openings 28 in the duct 27. A continuous air stream is thus created over those points which are most susceptible to accumulation of lint. In an alternative embodiment, the yarn tubes extend with clearance through openings in the duct so that their entrance ends are disposed externally of the duct but close to those openings.

4 Claims, 4 Drawing Sheets

YARN CREELS

BACKGROUND OF THE INVENTION

This invention relates to apparatus for mounting yarn cones, packages or the like, and to a yarn creel embodying such apparatus.

It is well known that creels are a major source of lint generation, particularly at points where the yarn is drawn off from yarn cones or packages. There is also a tendency for lint to be shed at points where the yarn enters tubes through which it is conveyed to a processing machine, such as a knitting machine. If the generation of lint is left unchecked, then the lint can seriously contaminate the surrounding working environment, giving rise inter alia to fire and health hazards. Also, lint tends to settle on the upper surfaces of cones or packages when these are out of use so that, when those cones or packages are subsequently used, the lint is carried off with the yarn and into the knitting process. This gives rise to faults in the fabric being knitted and consequential loss of production.

In order to deal with this problem, creels are often encased in an enclosure through which an air flow is created, e.g. by means of fans. The air flow entrains most of the lint generated in the creel, and the lint is then removed by passing the air through a filter. This type of arrangement does however rely upon the filter being cleaned regularly to allow free movement of air therethrough. However, such cleaning is a time-consuming process and is frequently not done correctly, if at all.

Also, the fact that the creel is enclosed means that access to its parts is difficult. Although doors are provided in the enclosure to allow an operative e.g. to change the cones or packages and to feed the yarns into the entrance ends of the yarn tubes in the first instance, access is nevertheless rather restricted. Moreover, the enclosure obscures the operative's view of the creel.

De-A-40 30 940 discloses a yarn creel in which lint is dislodged from the yarn cones or packages by means of streams of gas directed from openings in a series of ducts. However, these openings are not disposed particularly close to the cones or packages, and their cleaning action is consequently not particularly efficient.

SUMMARY OF THE INVENTION

According to a first aspect of the present invention, the above-mentioned problems are obviated or mitigated by mounting the cone/package mounting point on the actual duct means from which the gas streams are emitted, and by positioning the openings closely adjacent to those mounting points. Preferably, each opening is directed at a position normally occupied by an upper surface of the cone or package mounted on a respective one of the mounting points. Conveniently, the mounting points are arranged in at least one generally vertical row, and the duct means comprises a respective duct for each row. Desirably, the means for creating a flow of gas is a fan or fans.

According to a second aspect of the present invention, further duct means is also provided adjacent to exit points through which yarn drawn off from the cones or packages is guided to leave the creel, and gas is drawn into the further duct means and is re-emitted into the creel through the openings in the first mentioned duct means. Desirably, the exit points are positioned generally at or adjacent to an entrance or entrances to the further duct means. Advantageously, the exit points are constituted by entrance ends of respective tubes through which the yarn is conveyed from the creel. The tubes can extend along the interior of the further duct means and thence to the exterior of the creel. Means is preferably provided to direct a localized stream of gas over the entrance end of each tube.

Conveniently, the further duct means includes a plurality of openings through which gas is drawn from the creel, the entrance end of each tube being disposed closely adjacent to one of the openings. Preferably, the tubes extend through the openings in the further duct means, with the entrance ends thereof disposed outside the latter. In the case where the creel is circular, the further duct means can comprise a plurality of generally vertical ducts disposed in angularly spaced relation around the creels.

Preferably, the exit points are arranged in a series of generally vertical rows which are laterally spaced across the cree. The further duct means comprises a single duct which extends laterally across the creel, the duct having a plurality of generally vertical entrance slots which face the mounting points, the exit points in each of the generally vertical rows being positioned adjacent to a respective one of the entrance slots.

Advantageously, the means for creating a gas flow re-emits the gas from the first duct means in a direction generally towards the entrance or entrances of the second duct means. Desirably, the means for creating a gas flow is arranged so that the direction of gas flow therethrough can be reversed in order to discharge lint accumulated on the filter means.

The creel can also comprise valve means operable when the direction of gas flow is reversed to direct the lint from the filter means to a collection point.

Preferably, the means for creating a gas flow and the filter means are disposed in a chamber with which the second duct means communicates at an opening, and the valve means includes a valve disposed in the opening. Conveniently, the valve is in the form of a flap which opens in response to flow of gas in one direction from the further duct means to the chamber, and which closes in response to flow of gas in the chamber in the reverse direction. Alternatively, the flap can be opened and closed mechanically by some form of control means.

Desirably, the collection point communicates with the chamber at an opening, and the valve means comprises a valve which is disposed in the opening and which is normally closed but which opens in response to flow of gas in the reverse direction. Preferably, the chamber is disposed above or below the creel.

Conveniently, the creel is contained in an enclosure or housing which is open at its front.

In DE-A-40 30 940, streams of gas are also directed generally towards the entrance ends of tubes through which the yarns exit the creel. However, the ducts from which these gas streams are emitted oscillate back and forth so that the gas streams each sweep across a respective sector. The exit points are positioned in only part of this sector, so the direction of the gas streams towards the exit points is only intermittent. This again does not achieve a particularly efficient cleaning action.

According to a third aspect of the present invention, each yarn tube extends along the interior of the duct or ducts, and the entrance end thereof is disposed closely adjacent to a respective one of the openings in the duct or ducts. In the case of a circular creel, a plurality of such ducts are preferably provided in angularly spaced relation around the creel. Desirably, the tubes extend through the openings in the duct or ducts with the entrance ends thereof disposed outside the latter.

Conveniently, the creel comprises a first vertically-arranged section, means operative to create a generally vertical flow of gas through the first section in one direction, and a second vertically-arranged section in which the mounting points and the entrance ends of the tubes are disposed and through which the gas flows generally vertically in the opposite direction, the first section being screened from the second section. In the case of a circular creel, the first section is preferably disposed centrally of the creel, the second section at least partially surrounds the first section, and the gas flow is directed generally radially of the creel at the upper and/or lower ends thereof between the first and second sections.

BRIEF DESCRIPTION OF THE DRAWINGS

The invention will now be further described, by way of example only, with reference to the accompanying drawings, in which.

DESCRIPTION OF THE PREFERRED EMBODIMENTS

Figure 2:
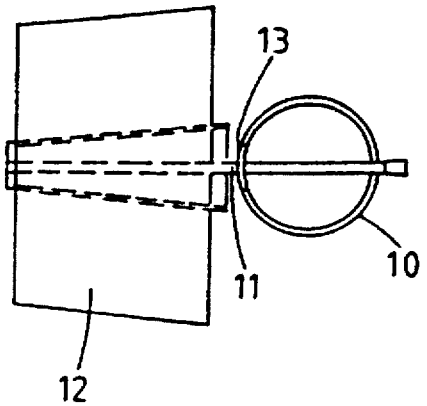
FIG. 2 is a cross section taken along the line 2—2 in FIG. 1.
Figure 1:
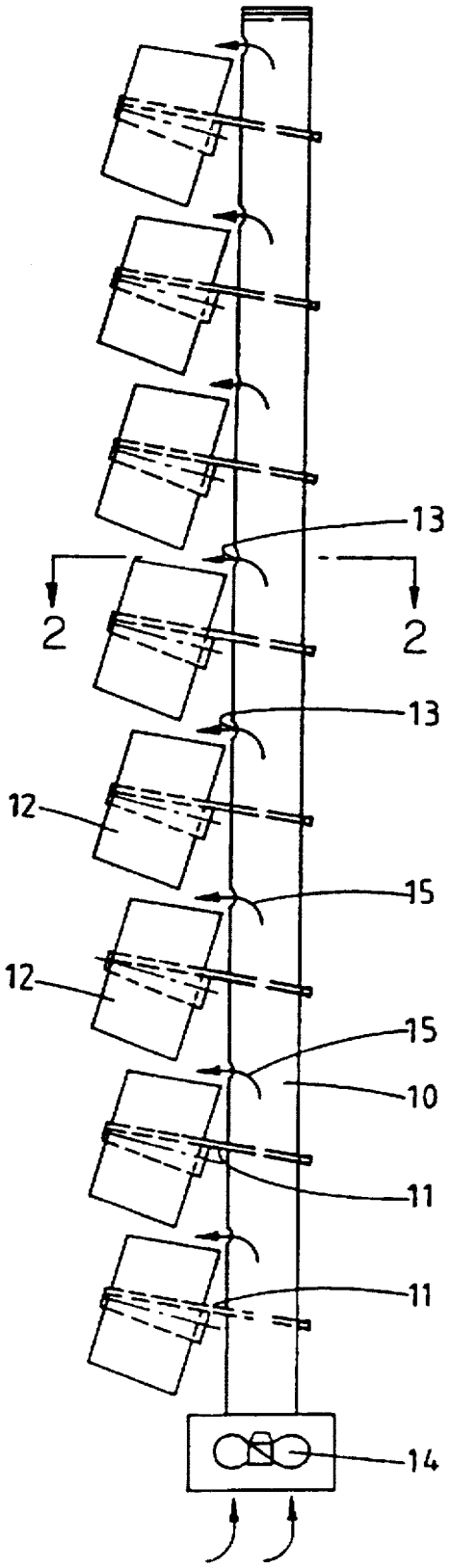
FIG. 1 is a schematic view of an apparatus for mounting yarn cones or packages, according to a first aspect of the present invention.

Referring first to FIGS. 1 and 2, there is shown an apparatus comprising an upright duct 10 in the form of a hollow tube of circular cross-section. The duct 10 has mounted thereon at vertically spaced intervals a series of mounting pins 11 which receive cones or packages 12 of yarn, each pin 11 being angled slightly upwardly. A series of generally circular openings 13 are formed in the duct 10, one such opening 13 being positioned adjacent to each of the pins 11, but being spaced slightly above each pin 11. Each opening 13 is directed at a location normally occupied by an upper surface of the cone or package 12 mounted on the respective pin 11.

In use, air or another gas is forced through the duct 10 by means of a fan or fans 14. The gas issues from the openings 13 as indicated by arrows 15 in FIG. 1, and thereby blows off any lint which has accumulated on the cone or package 12. Extraction means may be provided elsewhere in the working environment to extract the air with the entrained lint and pass this through a filter. This arrangement ensures a close and constant relationship between the streams of gas emitted from the openings 13 and the yarn cones or packages 12.

Although in the illustrated embodiment the fan or fans 14 are located at the bottom end of the duct 10, they can be located elsewhere if desired.

Figure 5:
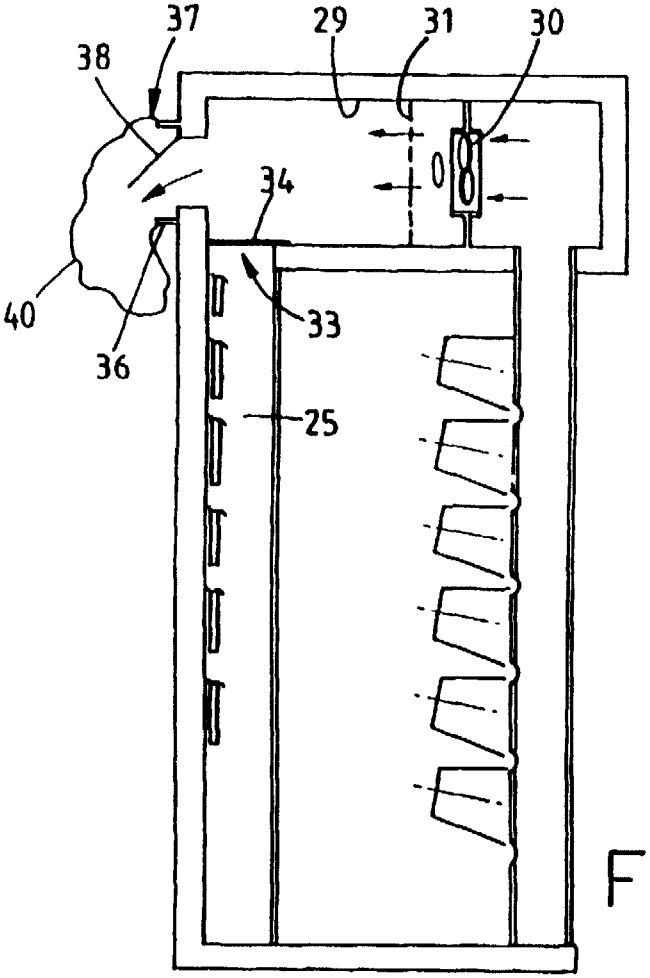
FIG. 5 is a similar view to FIG. 3, but showing the creel in a different operating condition.
Figure 3:
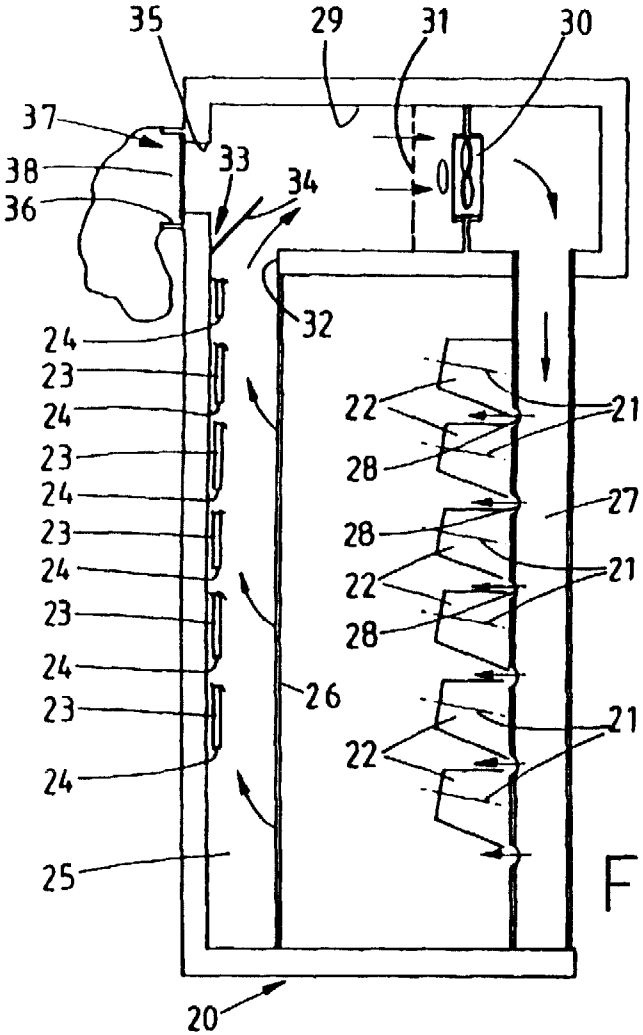
FIG. 3 is a schematic side view of a yarn creel according to a second aspect of the present invention.

The apparatus described above will normally find its best use in preventing the accumulation of lint on cones or packages 12 which are held in reserve in a yarn creel. However, the apparatus can also be used to remove accumulating lint from cones or packages 12 which are actually in use, as will now be described in relation to the yarn creel shown in FIGS. 3 to 5.

The creel (designated 20) includes at its front a plurality of mounting points 21 on which are mounted yarn cones or packages. The mounting points 21 are arranged in a series of generally vertical rows which are laterally spaced across the width of the creel 20. These rows are positioned in pairs, with the mounting points 21 in one row of each pair being on the same level as their counterparts in the other row. In use, one of these paired mounting points 21 receives a yarn cone or package 22 which is actually in use at a given time, while the other receives a reserve cone or package 22'.

At the rear of the creel 20 there are positioned the entrance ends of a plurality of tubes 23, through which the yarns are respectively conveyed to a processing machine, such as a knitting machine (not shown). These entrance ends constitute points 24 from which the yarns are guided to exit the creel 20, and these points 24 (and thus the tubes 23) are also arranged in a series of generally vertical rows which are spaced laterally across the width of the creel 20, there being one such row for each pair of rows of mounting points 21.

A duct 25 is also provided at the rear of the creel 20, and extends across the width of the creel 20. The duct 25 contains a plurality of generally vertical entrance slots 26, one for each row of tubes 23. The entrance ends of the tubes 23 in each row are positioned adjacent to the respective slot 26, but at the rear of the duct 25. This enables an operative to gain access to the tube ends for initial threading of the yarns.

At the front end of the creel 20, there are a plurality of further ducts 27 which extend generally vertically and which are spaced laterally across the creel 20. Each of these ducts 27 is positioned adjacent to a respective one of the rows of the mounting points 21, and contains a series of orifices 28 each of which is located adjacent to a respective one of the mounting points 21.

On the top of the creel 20 there is disposed a chamber 29 which contains air circulation means in the form of a fan or fans 30, and which also contains a filter panel 31. The ducts 27 communicate directly with a forward end of the chamber 29, while the duct 25 communicates with the rear of the chamber 29 at an opening 32 in which there is disposed a one-way valve 33 having a pivotable flap 34. Also communicating with the rear of the chamber 29 at an opening 35 is a collection point 36, there being disposed in the opening 35 a valve 37 having a pivotable flap 38.

In normal operation, the fan or fans 30 cause air to be drawn from the creel 20 into the duct 25 through the slots 26. The suction effect thereby created at the entrances to the slots 26, and the upward movement of air within the duct 25 itself, create a considerable movement of air around the entrance ends of the tubes 23, thereby preventing the build-up of lint at those locations. Thereafter, the air passes through the chamber 29, through the ducts 27, and is re-emitted into the creel 20 through the orifices 28. Each orifice 28 is directed towards the upper surface of the cone or package 22, 22' mounted on the respective mounting points 21, and the stream of air issuing from each orifice 28 also prevents the accumulation of lint at these locations.

Figure 4:
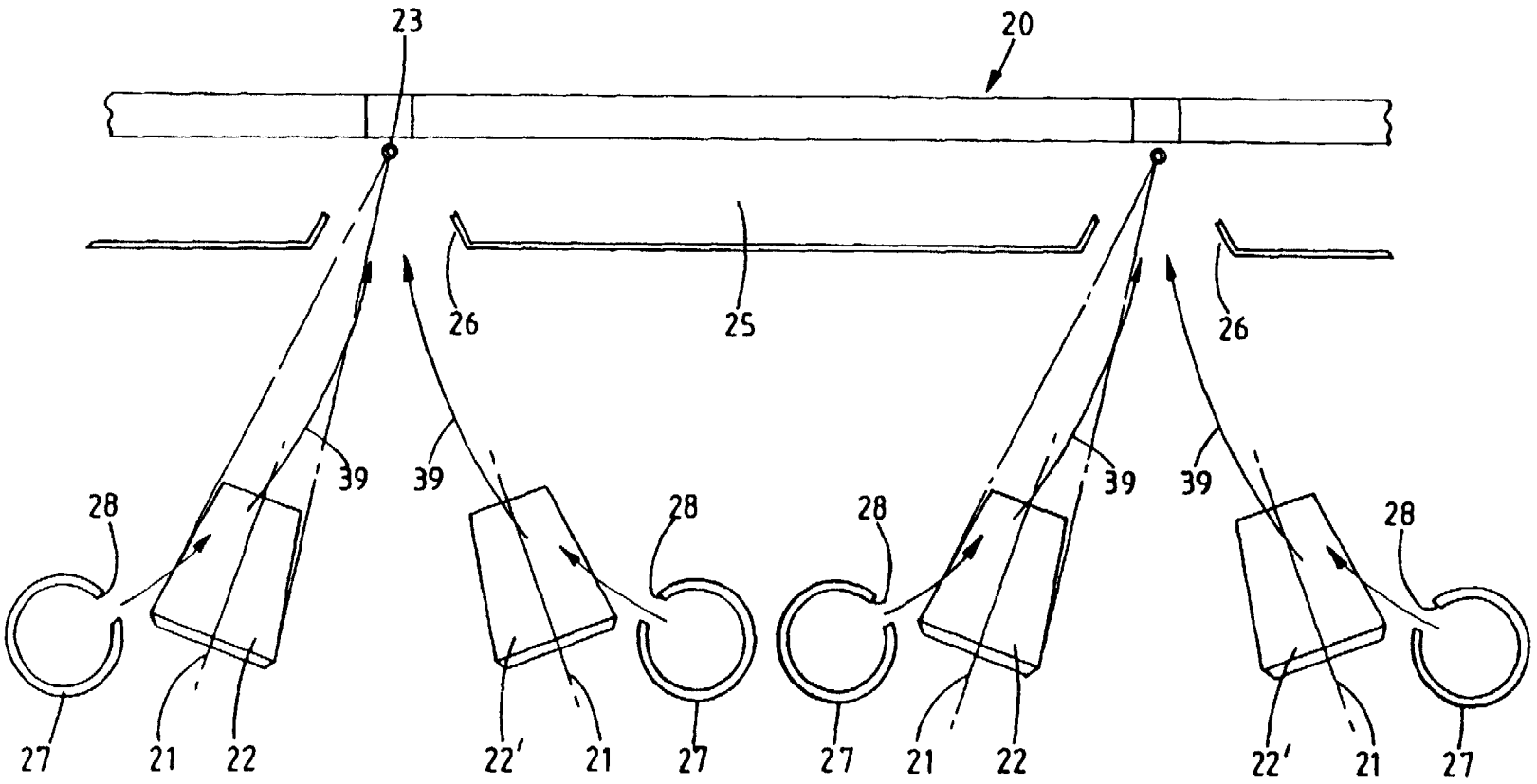
FIG. 4 is a schematic plan view of part of the creel shown in FIG. 3.

As can be seen to advantage in FIG. 4, the orifices 28 are directed generally towards the slots 26, so that much of the air issuing through the orifices 28 passes through the creel 20 and is drawn into the duct 25 once again, in the manner indicated by the arrows 39. The resultant re-circulation of the air causes the lint to be entrained in the air flow and to be carried up through the duct 25 into the chamber 29, where it is removed by passage of the air through the filter panel 31.

During normal operation, the flap 34 of valve 33 is held open by the flow of air from the duct 25 into the chamber 29, the flap 38 of valve 37 is held closed by the suction effect created in the chamber 29 by the fan or fans 30. This causes lint to accumulate on the rearward side of the filter panel 31. In order to remove the accumulated lint from the panel 31, the direction of rotation of the fan or fans 30 is reversed, thereby causing air to flow in the reverse direction through the chamber 29, as indicated by arrows in FIG. 5. Under these conditions, the flap 34 of valve 33 closes to prevent lint from passing back into the duct 25, while the flap 38 of valve 37 opens enabling the lint to be discharged into a bag or other receptacle 40 at the collection point 36.

Cleaning of the filter panel 31 is thus a very simple operation, and this simplicity provides an incentive for an operative to perform the cleaning operation on a regular basis. It is also possible to automate the cleaning process by providing a timer which at intervals automatically reverses the operation of the fan or fans 30 for a period of time.

Where a number of creels are provided in the same working space, instead of providing a separate receptacle 40 for each creel, the collection points on all the creels can be connected to a central collection location.

In the above-described creel, the flap 34 of valve 33 and the flap 38 of valve 37 are opened and closed by the pressure of air flowing through the system. In an alternative arrangement (not shown), this can be done mechanically using some form of control.

It will be manifest from the above description that the air issuing from the ducts 27 at the front of the creel 20 is directed rearwardly into the creel 20 itself. This air, along with the lint generated within the creel 20, is then drawn out through the duct 25 at the rear of the creel 20, thereby reinforcing the flow of air from front to rear. Consequently, there is little or no tendency for any lint to escape from the front of the creel 20, so the creel 20 can be left open. In other words, there is no need for the creel 20 to be totally enclosed in a casing and, in particular, any such casing can be open at the front. However, for added security of the integral functioning of the creel 20, for example when processing colored yarns, it may be desirable to provide the front of the creel 20 with doors (preferably sliding ones) to prevent the yarn from being contaminated by lint entering the creel 20 from the surrounding environment.

Moreover, in addition to the cleaning effects already described, there is a tendency for the air to flow from each orifice 28 towards the respective slot 26 in the same direction as the yarn being off-wound from the cone or packages 22 on the respective mounting point 21. This generally horizontal air flow in the direction of yarn travel also assists in keeping the yarn free from lint.

Furthermore, it will be apparent from FIG. 4 that each slot 26 is equidistant from the two rows of mounting points 21 that it faces. Consequently, the same beneficial cleaning effect is obtained irrespective of which of the paired mounting points 21 is being used to supply yarn.

In the above-described embodiment, the chamber 29, the fan or fans 30 and the filter panel 31 are disposed above the creel 20. In an alternative arrangement (not shown), they are disposed below the creel 20 instead.

Figure 6:
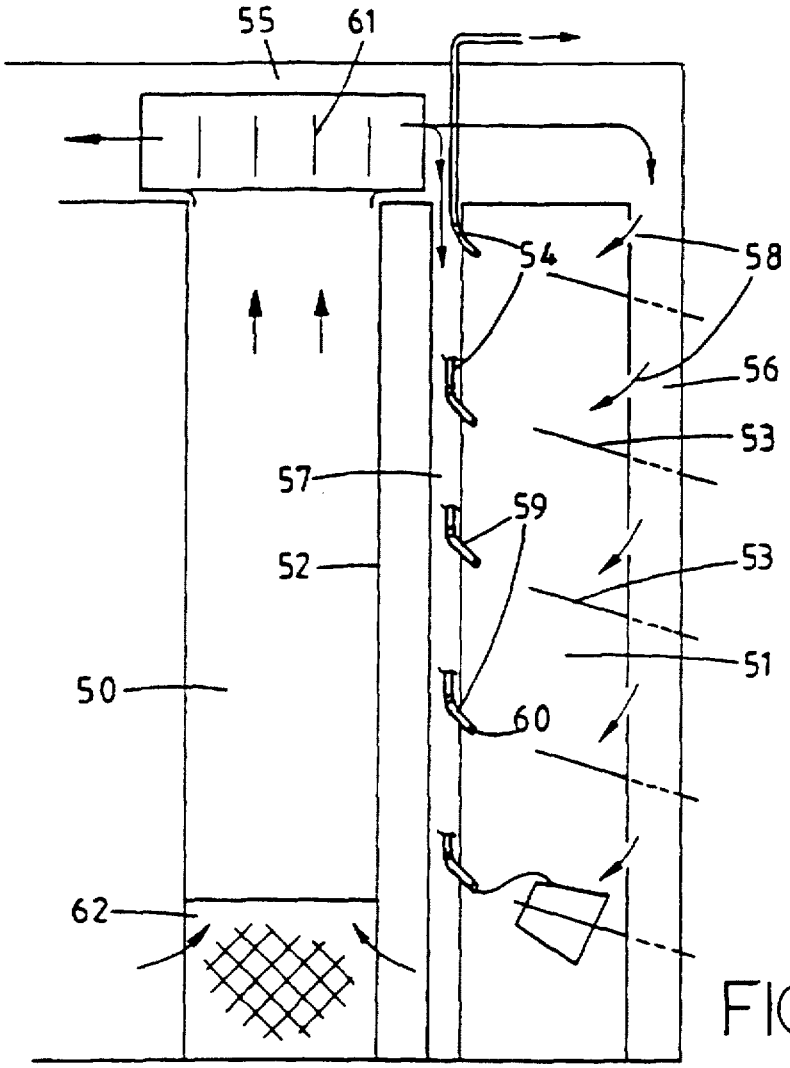
FIG. 6 is a schematic sectional view of a modified yarn creel.
Figure 7:
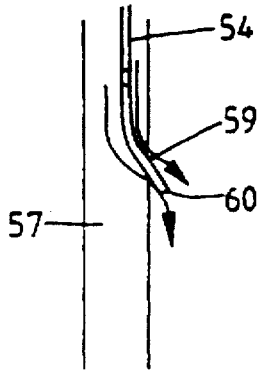
FIG. 7 is an enlarged view of part of the creel shown in FIG. 6.
Figure 8:
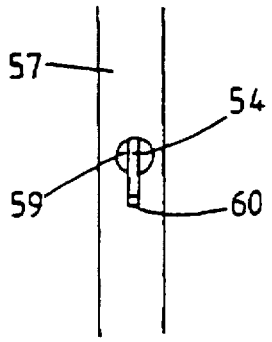
FIG. 8 is a front view of the part shown in FIG. 7.

A modified arrangement is shown in FIGS. 6 to 8, wherein the creel is of the circular type and includes a central first section 50 surrounded by an annular second section 51 and screened therefrom by means of a cylindrical side wall 52. Disposed in the second section 51 are a series of mounting points 53 for yarn cones or packages, and a series of tubes 54 through which yarn is fed from the cones or packages to a processing machine, such as a knitting machine (not shown). A chamber 55 is provided at the upper end of the creel and communicates with a first series of ducts 56 and a second series of ducts 57 in the second section 51, the ducts 56, 57 in each series being angularly spaced apart around the creel, with the ducts 57 disposed inwardly of the ducts 56.

The ducts 56 extend adjacent to the mounting points 53, and are each provided with a series of vertically-spaced openings directed towards those points 53, in much the same manner as in the previous embodiments. Each of the ducts 57 has extending along its interior a number of the tubes 54, which thence pass to the exterior of the creel. Each duct 57 has a series of vertically spaced openings 59 through which the associated tubes 54 respectively extend with clearance, terminating at an inlet end 60 which is disposed outside the duct 57 and closely adjacent to the respective opening 59. This arrangement can be seen to advantage in FIGS. 7 and 8.

A fan or fans 61 is/are disposed in the chamber 55 to draw air upwardly through the first section 50. The air stream thus created is then diverted to flow radially outwardly in the chamber 55 itself, and thereafter enters the ducts 56 and 57 via their upper ends. The air then flows down the ducts 56 and 57 and is emitted as a series of localized streams through the openings 58 and 59. The air streams emitted through the openings 58 are directed towards the upper surfaces of the yarn cones or packages and serve to prevent lint from accumulating on those surfaces. The air streams emitted through the openings 59 are directed over the inlet ends 60 of the tubes 54 and provide a continuous cleaning action to also prevent the accumulation of lint at these locations. Thereafter, the air flows downwardly towards the lower end of the outer section 51, where it is drawn through a filter 62 back into the central section 50, the filter serving to remove entrained lint from the air stream. If desired, this filter can be rotated and a wiper blade can be provided to provide a continuous cleaning action on the surface of the filter as the filter rotates.

We claim:

1. An apparatus for mounting yarn packages, comprising:

a duct having therein a plurality of openings, a plurality of mounting points mounted directly on said duct and adapted to receive the yarn packages; each of said mounting points being disposed closely adjacent to a respective one of the openings;

and gas flow means operative to create a flow of gas outwardly through the openings in said duct, wherein the flow of gas impinges upon the yarn packages to entrain lint deposited thereon.

2. The apparatus as claimed in claim 1, wherein each opening is disposed closely adjacent to a position normally occupied by an upper surface of the yarn package received on the respective mounting point, and said gas flow means is operative to create a flow of gas across that upper surface.

3. The apparatus as claimed in claim 1, wherein the mounting points are arranged in at least one vertical column.

4. The apparatus as claimed in claim 1, wherein the gas flow means comprises at least one fan.

* * * * *